United States Patent [19]

Granberg

[11] B 4,014,739

[45] Mar. 29, 1977

[54] MOLD CONSTRUCTION HAVING REMOVABLE BASE MEMBER

[75] Inventor: Frederick M. Granberg, Knoxville, Tenn.

[73] Assignee: International Paper Company, New York, N.Y.

[22] Filed: May 9, 1974

[21] Appl. No.: 468,421

[44] Published under the second Trial Voluntary Protest Program on March 30, 1976 as document No. B 468,421.

[52] U.S. Cl. ..... 162/274; 162/411; 249/113; 249/164

[51] Int. Cl.[2] ..... B41B 11/60; D21J 7/00

[58] Field of Search ..... 162/411, 382, 218, 228, 162/387, 274, 273; 425/440, DIG. 44; 249/102, 112, 113, 164

[56] References Cited

UNITED STATES PATENTS

| | | | |
|---|---|---|---|
| 1,135,381 | 4/1915 | Kenney | 249/113 X |
| 2,174,425 | 9/1939 | Schlumbohm | 249/112 X |
| 2,971,237 | 2/1961 | Graham | 425/DIG. 44 |
| 3,802,963 | 4/1974 | Lee et al. | 162/228 X |
| 3,838,955 | 10/1974 | Dubbeld | 249/113 X |

*Primary Examiner*—S. Leon Bashore
*Assistant Examiner*—Richard V. Fisher
*Attorney, Agent, or Firm*—Fitch, Even, Tabin & Luedeka

[57] ABSTRACT

An improved mold construction is disclosed which is particularly useful in the manufacture of molded pulp products. The mold construction includes a rigid foraminous base member shaped to define the desired product, and a support frame having a first groove adapted to receive the marginal edge of the base member and a second groove which releasably receives a retainer member. The frame support is manipulatable to allow insertion and removal of the marginal edge of the base member into and from the first groove when the retainer member is removed from the second groove, but may not be so manipulated when the retainer member is inserted within the second groove. In one embodiment, the retainer member is separable from the support frame, while in an alternative embodiment the retainer member is formed integral with the support frame.

13 Claims, 5 Drawing Figures

MOLD CONSTRUCTION HAVING REMOVABLE BASE MEMBER

The present invention relates generally to a mold construction for use in an apparatus for making molded pulp products or the like, and more particularly to a mold construction having a novel support frame.

In the usual procedure for forming molded pulp products, a foraminous mold is submerged in a pulp suspension, generally termed a furnish which may comprise, for example, paper fibers suspended in a liquid such as water, for a preselected period of time while suction is applied across the mold to draw liquid from the furnish through the mold and accumulate a layer of pulp on the mold. The wet pulp layer is then dewatered and the dry molded pulp product is removed from the mold.

In one type of apparatus for making molded pulp products, a plurality of molds are carried on a belt which has a run movable through a furnish channel. Each of the molds includes a relatively rigid perforated base member which may have one or more screen members secured against the product forming surface such that the pulp fibers are deposited on the screens. The perforated base member and associated screens are supported at their marginal edges by a support frame which, in turn, is secured to the belt for movement therewith through the furnish channel.

It is a common practice to employ such molded pulp product making apparatus for making different shaped pulp products such as plates and trays and the like. If a number of different products of generally the same size but varying in profile configuration are to be made with a particular molded pulp product making apparatus, it is desirable that the mold support frames be adapted to allow interchanging of perforated mold base members having different profile configurations but having generally similar marginal edge configurations. To this end, known mold support frames include a base portion which is generally fixedly secured to a movable belt, and a retainer or clamping portion which is releasably secured onto the base portion and defines therewith a groove to receive and support the marginal edge of the perforated base member of a mold. In the known mold support frames, the upper retainer or clamping portion is made of a relatively rigid material, such as a rigid plastic or metallic material, and is secured to the base portion through suitable means such as screws and the like. It will be appreciated that with such constructions, the downtime of the apparatus while the retainer or clamping portion of the mold is detached from and reattached to the base portion during a mold change results in reduced production and economic losses.

One of the primary objects of the present invention is to provide a mold construction having a novel support frame which may be manipulated to allow a foraminous mold base member to be readily assembled therewith or disassembled therefrom.

Another object of the present invention is to provide a mold construction having a novel support frame which may be adapted for manipulation to allow interchanging of different foraminous mold base members without the need for removing and reattaching screws and the like as found in the prior art devices.

In accordance with the present invention, a support frame for supporting the perforated base member of a foraminous mold is provided wherein the support frame is made of a material capable of manual manipulation and flexing, and wherein the support frame includes a first groove to receive a marginal edge of the perforated mold plate member and a second groove which releasably receives a retainer member. The support frame is manipulatable when the retainer member is removed from the second groove to allow insertion of the marginal edge of the base member into or removal from the first groove. The support frame is adapted for interlocking supporting relation with the marginal edge of the mold base member when the retainer member is disposed within the second groove.

A feature of the present invention lies in the provision of a retainer strip which may be separable from or, in an alternative embodiment, formed integral with the support frame of the mold, and wherein the retainer member may be selectively withdrawn from its associated groove to allow manipulation of the support frame for inserting or removing a foraminous mold base member from a supporting groove within the support frame.

Further objects and advantages of the present invention, together with the organization and manner of operation thereof, will become apparent from the following detailed description of the invention when taken in conjunction with the accompanying drawing wherein like reference numerals designate like elements throughout several views, and wherein.

Figure 1:
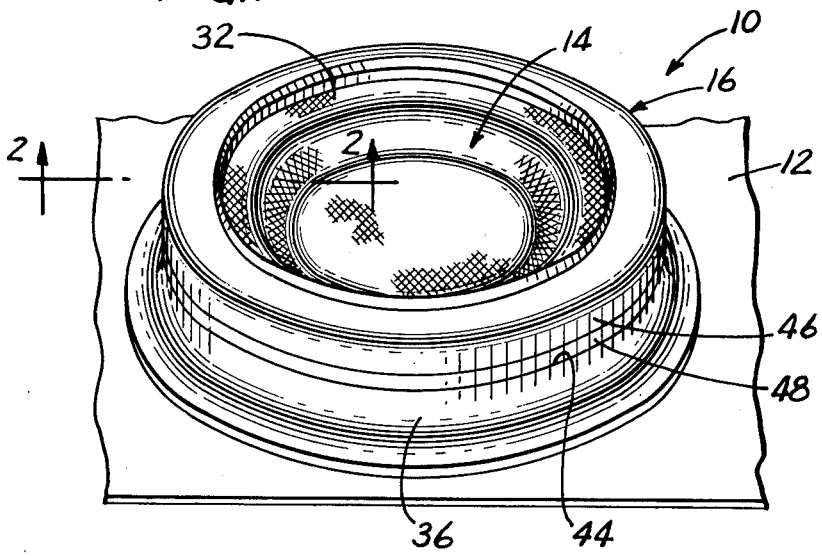
FIG. 1 is a perspective view of a mold construction in accordance with one embodiment of the present invention.

Referring now to the drawings, and in particular to FIG. 1, a mold constructed in accordance with one embodiment of the present invention is indicated generally at 10. The mold 10 to be described hereinbelow may be attached to means, such as a liquid impervious flexible belt, a portion of which is shown at 12, adapted to submerge the mold 10 beneath the surface of a furnish which may be of a conventional type such as paper or pulp fibers suspended in a liquid, i.e., usually water. While the mold 10 is submerged in the furnish, suction is applied to one side thereof to draw liquid from the furnish through the mold. In the illustrated embodiment, such suction would normally be applied to the mold 10 from the side of the belt 12 opposite the side upon which the mold 10 is secured. As the liquid is drawn through the mold, pulp fibers in the furnish are filtered onto the surface of the mold which is exposed to the furnish to develop a layer of pulp on the exposed surface of the mold. It is this layer of pulp formed on the exposed surface of the mold 10 which will hereinafter be referred to as the molded pulp product.

An example of a molded pulp product making apparatus of the type in which the mold 10 may be employed is disclosed in copending application Ser. No.

114,514, filed Feb. 11, 1971 now U.S. Pat. No. 3,802,963, issued Apr. 9, 1974. As therein disclosed, an endless flexible belt having a plurality of foraminous molds secured thereon is adapted to be moved through a furnish channel for forming a layer of fibrous pulp on the exposed surfaces of the molds, whereafter the molds are moved through de-watering and drying stations and then to a station in which the formed molded pulp products are ejected from the molds.

The mold 10 includes a foraminous mold portion, indicated generally at 14, and support frame means, indicated generally at 16, which supports the foraminous mold portion 14 on the flexible belt 12. The foraminous mold portion 14 in the illustrated embodiment includes a perforated rigid base member 18 which is shaped to define the desired pulp product and forms a liquid pervious barrier between a suction applied to one side of the base member and a furnish disposed on that side of the base member opposite the applied suction. In the illustrated embodiment, the base member 18 has a lower or bottom surface 20 which overlies an opening 22 formed in the belt 12 such that sucton may be applied through the opening 22 against the bottom surface 20 of the base member 18. In the illustrated embodiment, the support frame means 16 is generally annular and, in cooperation with the foraminous mold portion 14, defines a circular area of the base member 18 which is exposed through the opening 22 in the belt 12 to suction so as to produce a molded pulp product taking the form of a plate of approximately 9-inch diameter, such as depicted generally at 24 in FIG. 5.

The rigid base member 18 of the foraminous mold portion 14 of the mold 10 comprises a relatively thin, liquid pervious element of substantially uniform cross-section. The base member 18 may be fabricated from a plastic, such as polycarbonate, as by heat-forming a sheet of the plastic into the desired geometrical configuration which will produce the desired product, such as the plate 24. In the preferred mold construction, the base member 18 is perforated at spaced apart locations over the area thereof overlying the opening 22 in the belt 12 to provide passages for the flow of liquid from the pulp suspension or furnish through the foraminous mold 14 in response to an applied suction. To this end, the base member 18 has a plurality of spaced apart perforations or openings 26 therethrough provided generally uniformly over the area of the base member overlying the opening 22 in the belt 12, which perforations may be cylindrical, or cylindrical with frustoconical extensions, or frustoconical with the narrow portion of the perforation being adjacent the uppermost surface of the base member. Perforations having a diameter in the order of 1/16 inch have been found effective in providing the desired results and are preferred for achieving the desired liquid flow through the foraminous mold 14 with minimum plugging of the perforations by fibers. The perforations 26 may be spaced apart in the order of 7/16 inch. The base element 18 has an upper surface 28, as considered in FIG. 2, which preferably is embossed in a mesh-like pattern (not shown) to further improve the response to suction by providing a network of interconnected surface canals on the surface 28 along which liquid may readily flow toward the several perforations 26 thence through the base member 18.

First and second screen means, indicated at 30 and 32, respectively, are preferably provided to overlie the base member 18 in nesting relation therewith so as to be supported by the base member. The first screen 30 preferably is in intimate contact with the upper surface 28 of the base member 18 such that the screen strands contact the base member. The second screen 32 overlies the first screen 30 and is in intimate contact therewith where the respective strands of the screens 30 and 32 cross. The unfilled spaces between adjacent strands of the screens 30 and 32 define openings for the flow of liquid therethrough. The openings of the screen 30 are preferably larger than the corresponding openings in the second screen 32. The openings 26 in the base member 18 are larger in size than the openings defined by the mesh of the screen 30 so that liquid being drawn through the screens and base member 18 in response to suction applied through the opening 22 in the belt 12 across the foraminous mold 14 passes through the openings which have increased dimension in the direction of flow. A screen 30 of between about 30 and 50 mesh overlayed on the rigid base member 18, and a second screen 32 having between about 75 and 100 mesh overlayed on the first screen 30, has been found to produce the desired filtering action without plugging and with minumum escape of fibers through the mold.

The support frame means 16 serves to releasably support the foraminous mold means 14 through supporting engagement with the marginal peripheral edges of the base member 18 and overlying screens 30 and 32. Noting FIG. 1, taken in conjunction with FIGS. 2 and 3, the support frame means 16 includes a body member 36 which, in the illustrated embodiment, comprises an annular body having a lower base surface 38 which is adapted to be secured to the upper surface of the flexible belt 12 as through a suitable adhesive, such as an epoxy adhesive. The body member 36 is made of an elastomeric material such as a suitable rubber having a Durometer A hardness reading in the order of 80, or a suitable plastic material. By elastomeric material is meant a material which is resilient and which will, when deformed from a normal position, return to its normal position when the force causing the material to be deformed is removed therefrom. The body member 36 may be made by extruding processes to obtain a length of material having the desired cross-sectional configuration, whereafter a predetermined length of the extruded strip is formed into an annulus to provide the desired configuration for the support frame means 16. It will be understood that other manufacturing techniques could also be employed to produce the support frame means 16.

The body member 36 is formed with an inner peripheral surface 40 having a diameter substantially equal to the diameter of the opening 22 in the belt 12 such that when the base member 36 is secured onto the belt 12, the inner opening defined by the peripheral surface 40 will be coextensive with the opening 22 in the belt 12. The body member 36 has a first annular groove 42 formed in the inner peripheral surface 40. In the illustrated embodiment, the groove 42 has a generally U-shaped transverse configuration defined by a lower V-shaped annular groove or slot **42*a* and an upper downwardly directed annular generally V-shaped projection 42*b***.

The annular groove 42 in the body member 36 is adapted to receive the peripheral marginal edges of the base member 18 and overlying screens 30 and 32 of the foraminous mold means 14. The marginal edge of the base member 18 is formed to provide a downwardly directed depression **18*a* which extends the full peripheral extent of the marginal edge of the base member and has a generally V-shaped transverse cross-sectional configuration. The generally V-shaped annular depression 18***a* in the base member 18 is formed to substantially conform to the V-shaped groove 42*a* in the body member 36. The screens 30 and 32 conform to the configuration of the base member 18 and therefore have marginal edge portions conforming to the marginal annular depression 18*a* in the base member 18. When the marginal edge of the base member 18 and associated marginal edges of the screens 30 and 32 are inserted into the groove 42, there will be substantially full surface contact of the lower marginal surface of the base member with the annular V-shaped groove 42*a* in the body member 36. As the screens 30 and 32 are supported by the base member 18 and conform thereto, the downwardly directed annular V-shaped projection 42*b* will be in intimate contact with the upper surface of the upper screen 32. As will become more apparent hereinbelow, the U-shaped groove 42 in the body member 36 serves to provide an interlocking relation between body member 36 and the base member 18 and overlying screens 30 and 32 so as to releasably retain the base member and associated screens in supported relation within the groove 42 in the frame support means 16.

Figure 2:
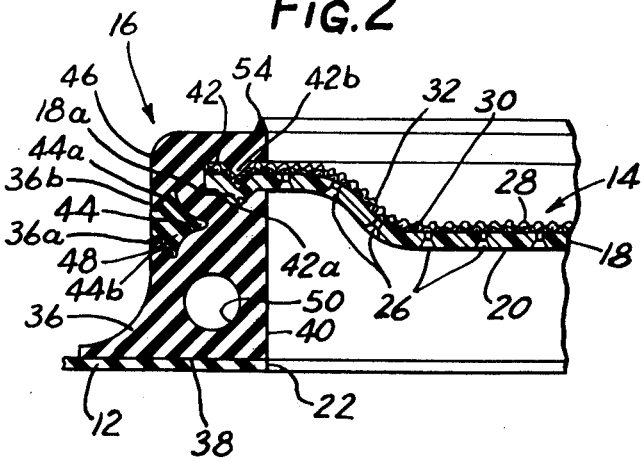
FIG. 2 is a partial vertical sectional view taken generally along the line 2—2 of FIG. 1.

In accordance with the present invention, the frame support means 16 is manually manipulatable to allow insertion or removal of the marginal edge portions of the base member 18 and associated overlying screens 30 and 32 within the annular groove 42. To facilitate such manipulation of the frame support means 16, the body member 36 is provided with a second annular groove 44 formed in an outer peripheral surface 46 of the base member 36. As shown in FIG. 2, the groove 44 has a generally irregular transverse sectional configuration and includes an upwardly extending groove or wing portion 44*a* and a downwardly directed groove or wing portion 44*b*. The groove 44 is adapted to receive a retainer member 48 which has a length substantially equal to the circumferential length of the annular groove 44. The retainer member 48 may be made of a suitable elastomeric material similar to the material employed for the body member 36, and has a transverse cross-sectional configuration generally similar to the cross-sectional configuration of the groove 44 in the body member 36. The retainer member 48, however, is preferably made slightly larger in cross-sectional area than the groove 44, considered with the groove 44 in its normal state without the marginal edges of the base member 18 and associated screens 30 and 32 being mounted within the annular groove 42, so that when the base member 18 and screens 30 and 32 are supported within the groove 42, insertion of the retainer member 48 into groove 44 causes the groove surface 42*b* to be compressed against the marginal edge of the base member 18 and screens 30 and 32. The retainer member 48 is adapted to be inserted into the groove 44 by spreading lip portions 36*a* and 36*b* of the body member 36 outwardly whereafter the lip portions are released to retain the retainer member 48 within the groove 44, as shown in FIG. 2.

The body member 36 of the frame support means 16 may be formed with an annular opening 50 therein which reduces the overall weight of the frame support means 16 and may be selectively positioned to further facilitate manipulation of the frame support means as necessary to insert and remove the marginal edges of the base member 18 and overlying screens 30 and 32 from the groove 42.

Figure 3:
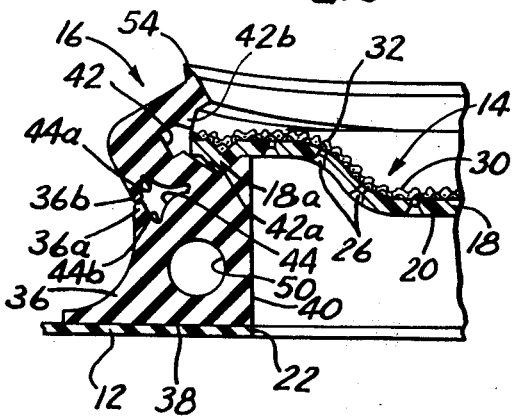
FIG. 3 is a partial sectional view similar to FIG. 2 but with the retainer ring removed and the support frame shown in a manipulated position to allow removal of the perforated base member.

With particular reference to FIG. 3, it can be seen that with the retainer member 48 removed from the second groove 44 in the frame support means 16, the body member 36 may be manipulated to spread or open the peripheral groove 42 such that the marginal edges of the base member 18 and overlying screens 30 and 32 may be readily inserted within the groove 42. Thereafter, releasing the upper portion of the body member 36 causes the annular surfaces 42*a* and 42*b* defining the groove 42 to contact the correspondingly shaped marginal edge surfaces of the base element 18 and the screens 30 and 32. The retainer member 48 is then inserted within the annular groove 44 and, because the retainer member 48 has a slightly greater size than the second groove 44, the projection 42*b* of the body member 36 is compressed downwardly against the marginal edge of screen 32 to effect a compressing interlocking relation of the projection 42*b* with the marginal edge of the foraminous mold means 14. The groove 44 is located relative to the groove 42 to enable the desired manipulation of the body member 36 when the retainer member 48 is removed from groove 44. In this manner, the foraminous mold means 14 is releasably supported by and secured to the support frame means 16 for movement and operation within a molded pulp product making apparatus as aforedescribed.

It will be understood that the described compressed fitting or interlocking of the marginal edges of the base member 18 and associated screens 30 and 32 within the groove 42 could also be obtained by providing the retainer member 48 with a cross-sectional area substantially identical in size to the cross-sectional area of the groove 48, and making the vertical height of the groove 42, considered between the groove defining surfaces 42*a* and 42*b*, slightly less than the thickness of the portions of the assembled base member 18 and screens 30 and 32 to be received within the groove 42.

When it is desired to change the foraminous mold means 14 to provide a differently configured base element 18, or when necessary to maintenance the base element 18 and/or screens 30 and 32, the retainer member 48 may be removed from the associated annular groove 44 in the base member 36 and the base member again manipulated to a position as shown in FIG. 3 allowing removal of the base member 18 and associated screens 30 and 32 from the support frame means 16.

The support frame means 16 may optionally be provided with an upwardly directed annular projection 54 which extends peripherally of the inner peripheral surface 40 of the base member 36 and has a generally inverted V-shaped configuration. The projection 54 comprises a cutting edge which may be heated and employed to sever a thin liquid impervious thermoplastic film sheet material which is caused to engage the cutting edge 54 so as to sever an area of the film interiorly of the annular projection or cutting edge 54. Such severed film sheet may then be drawn downwardly onto the pulp product (not shown) formed on the foraminous mold means 14 while the pulp product is heated after leaving a drying station. In this manner, the severed thermoplastic film may be heat bonded to the exposed surface of the pulp product.

Figure 4:
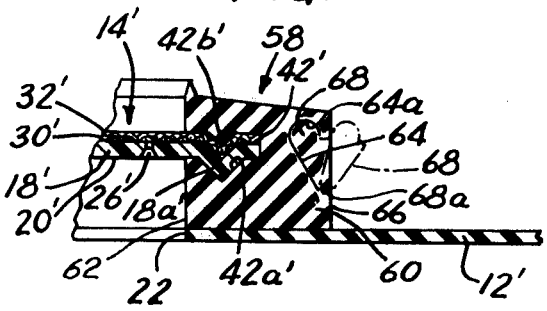
FIG. 4 is a partial sectional view generally similar to FIG. 2 but illustrating an alternative embodiment of a mold construction in accordance with the present invention.

FIG. 4 illustrates an alternative embodiment of a support frame means, indicated generally at 58, for supporting the foraminous mold means 14 in accordance with the present invention. The elements of the support frame means 48 which are common to the aforedescribed support frame means 16 are identified by like reference numerals with a prime (′) superscript. The support frame means 58 includes a body member 60 made of a suitable elastomeric material similar to the body member 36. The body member 60 has an internal peripheral surface 62 defining an opening within the support frame means 58 substantially equal in size to the opening 22′ in a flexible belt 12′ to which the support frame means 58 may be suitably secured.

The support frame means 58 includes a first groove 42′ which is formed within the inner peripheral surface 62 and extends the full periphery of the surface 62. The groove 42′ includes a generally downwardly directed V-shaped surface portion **42*a*′ and a downwardly directed V-shaped projection surface 42*b*′ which cooperate to receive the marginal edge 18*a*′ of a foraminous mold means 14′** in interlocking releasable relation therewith.

The support frame means 58 includes a second peripheral groove 64 formed in an outer peripheral surface 66 of the body member 60, the groove 64 having an upwardly directed internal curved portion **64*a*.**

In forming the groove 64, the portion of the body member 60 which is severed by forming the groove 64 is indicated at 68 and is integral with the body member 60 as at **68*a*. In this manner, the partially severed portion 68 of the body member 60 provides a retainer member which may be releasably inserted within the groove 64 by manipulating a lip portion 66*a* of the outer peripheral surface 66 of the body member 60.**

By withdrawing or removing the retainer member 68 of the body member 60 from the groove 64, the body member 60 may be readily manipulated to raise the depending projection **42*b*′ from the underlying screens and base member 18′ of the foraminous mold means 14′, in similar fashion to the aforedescribed manipulation of the body member 36 as shown in FIG. 3, to permit removal of the foraminous mold means 14′ from the support frame means 58. Similarly, such manipulation of the body member 60 with the retainer member portion 68 removed from the slot 64 allows insertion of the marginal edge portions of a base member 18′ and overlying screens 30′ and 32′ within the groove 42′. Thereafter, reinserting the retainer member 68 into the groove 64 serves to effect interlocking of the marginal edge of the foraminous mold means 14′ within the groove 42′ and prevents accidental or inadvertent withdrawal of the foraminous mold means from the frame support means 58.**

Figure 5:
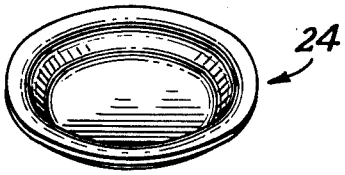
FIG. 5 is a perspective view of a molded pulp product in the form of a plate made with the mold construction of FIG. 1.

While the above described frame support means 16 and 58 have been described as defining generally annular support frames for supporting cooperation with generally circular foraminous mold means 14 to produce generally circular molded pulp products, such as the plate indicated at 24 in FIG. 5, it will be understood that the support frame means 16 and 58 may be made to support the marginal edges of foraminous molds which are not circular in plan configuration. Additionally, the peripheral edge of the foraminous mold means 14 may be provided with generally radial marginal projections which are received in supporting relation within suitable peripherally spaced segments of the groove 42, whereby the groove 42 need not be continuous. In this instance, however, it is desirable that the remaining peripheral edge portions of the mold means 14, disposed between such radial projections, be in contacting relation with the peripheral surface 40 disposed between the segmented groove 42. Similarly, the groove 44 may comprise two or more generally arcuate segments rather than a continuous groove, with the retainer member 48 comprising a plurality of segments each of which is releasably received within a segment of the groove 44.

It will also be appreciated that the described retainer members 48 and 68 may have cross-sectional configurations other than the illustrated embodiments within the scope of the present invention. While the first grooves 42 and 42′ in the inner peripheral surfaces of the support frames 16 and 58, respectively, have been described as being generally V-shaped to effect a positive interlock with the associated marginal edges of the foraminous mold means, it will be understood that annular grooves of other cross-sectional configurations cooperative with marginal edges of foraminous molds may be readily provided within the scope of the present invention. The particular profile configuration of the foraminous mold means 14 is only representative of one of a number of mold configurations contemplated by the present invention.

While preferred embodiments of the present invention have been illustrated and described, it will be obvious to those skilled in the art that changes and modifications may be made therein without departing from the invention in its broader aspects. Various features of the invention are defined in the following claims.

What is claimed is:

1. A mold for use with a molded pulp product making apparatus and the like, said mold comprising, in combination, base member means having a deposit surface adapted to receive a layer of pulp thereon and having a peripheral marginal edge, support frame means including a unitary resilient body member defining wall means circumscribing said base member and having interior and exterior surfaces, first circumferential groove means formed in the interior surface of said wall means receiving at least a portion of said marginal edge of said base member means in supporting relation, second circumferential continuous groove means of a predetermined transverse cross-sectional configuration formed in said exterior surface of said wall means, and elongated retainer means releasably received within said second groove means and having a length substantially equal to the circumferential length of said second groove means, said body member being made of a material capable of selective manipulation when said retainer means is removed from said second groove means to allow said marginal edge of said base member to be inserted and removed from said first groove means, said body member and said retainer means cooperating to substantially prevent removal of said base member from said first groove means when said retainer means is disposed within said second groove means.

2. A mold as defined in claim 1 wherein said retainer means has a transverse cross-sectional configuration similar to but larger in area than said predetermined cross-sectional configuration of said second groove, said retainer means being capable of effecting a compressed engagement of said body member on said portion of said marginal edge of said base member means when said retainer means is inserted within said second groove means whereby to effect interlocking of said support frame means with said base member means.

3. A mold as defined in claim 1 wherein said peripheral marginal edge of said base member means is defined by a depression formed peripherally therein, and wherein said first groove means in said body member has a transverse configuration generally similar to the transverse configuration of said marginal edge of said base member means so as to be cooperative therewith in a manner to securely retain said marginal edge of said base member means within said first groove means when said retainer means is disposed within said second groove means of said body member.

4. A mold as defined in claim 3 wherein said depression in said marginal edge portion of said base member means defines a generally V-shaped groove, and wherein said first groove means in said body member has a generally V-shaped groove receiving and interlocking with the said V-shaped groove in said marginal edge of said base member means to securely retain said marginal edge of said base member means therein when said retainer means is disposed within said second groove means in said body member.

5. A mold as defined in claim 1 wherein said body member is made of an elastomeric material capable of manipulation when said retainer means is removed from said second groove means to substantially increase the size of said first groove means for insertion and removal of said marginal edge portion of said base member means, said body member returning to its initial position after release thereof when said marginal edge portion of said base member is disposed within said first groove means whereby to retain said base member means therein when said retainer means is disposed within said second groove means in said body member.

6. The combination as defined in claim 1 wherein said retainer means is formed integral with said body member.

7. A mold as defined in claim 1 wherein said body member has an upstanding cutting edge thereon disposed peripherally of said first groove means.

8. Support frame means for supporting a plate member or the like having a peripheral marginal edge, said support frame means including a unitary resilient body member having an inner peripheral surface defining an opening through said body member and an outer peripheral surface, said body member having first continuous groove means formed in said inner peripheral surface receiving said marginal edge of said plate member in supporting relation therewith, said body member having second continuous groove means having a predetermined cross-sectional configuration formed in said outer peripheral surface of said body member and extending about the outer periphery of said body member, retainer means including at least one elongated retainer member having a length substantially equal to the circumferential length of said second groove means releasably received in said second groove means, said body member being manipulatable when said retainer member is removed from said second groove means to allow said marginal edge of said plate member to be inserted into and removed from said first groove means, said body member being substantially prevented from such manipulation when said retainer member is disposed within said second groove means.

9. Support frame means as defined in claim 8 wherein said first groove means comprises a continuous length groove having a cross-sectional configuration substantially identical to the transverse configuration of the peripheral marginal edge of the plate member to be received within said first groove means.

10. Support frame means as defined in claim 8 wherein said retainer member has a cross-sectional configuration sufficient to effect a compression of said body member against the marginal edge of said plate member when said marginal edge of said plate member is received within said first groove means and when said retainer member is disposed within said second groove means.

11. Support frame means as defined in claim 8 wherein said retainer member is formed integral with said body member.

12. Support frame means as defined in claim 8 wherein said body member is made of an elastomeric material, and wherein said retainer member is formed integral with said body member for movement between a first position received within said second groove means and a position substantially removed from said second groove means, said body member being manipulatable when said retainer member is removed from said second groove means to allow said marginal edge of said plate member to be inserted into and removed from said first groove means.

13. Support frame means as defined in claim 8 wherein the peripheral marginal edge of the plate member has a generally V-shaped groove formed peripherally thereof, and wherein said first groove means of said body member has a generally V-shaped groove corresponding to said V-shaped groove in said marginal edge of the plate member, said retainer member being of a size to cause said body member to compress against said marginal edge of said plate member when received within said first groove means and with said retainer member disposed within said second groove means.

* * * * *